US008611776B2

(12) United States Patent
Kozuma et al.

(10) Patent No.: US 8,611,776 B2
(45) Date of Patent: Dec. 17, 2013

(54) CLEANING APPARATUS AND IMAGE FORMING APPARATUS

(75) Inventors: Itaru Kozuma, Nagano (JP); Tomoyuki Shiiya, Nagano (JP); Tsutomu Sasaki, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 289 days.

(21) Appl. No.: 13/090,295

(22) Filed: Apr. 20, 2011

(65) Prior Publication Data

US 2011/0262170 A1 Oct. 27, 2011

(30) Foreign Application Priority Data

Apr. 27, 2010 (JP) ..... 2010-102210

(51) Int. Cl.
*G03G 15/00* (2006.01)

(52) U.S. Cl.
USPC ..... 399/71; 399/123

(58) Field of Classification Search
USPC ..... 399/71, 123, 343, 353–357; 15/256.5, 15/256.51
See application file for complete search history.

(56) References Cited

U.S. PATENT DOCUMENTS

| | | | | |
|---|---|---|---|---|
| 4,905,047 | A | 2/1990 | Ariyama | |
| 6,480,695 | B2 * | 11/2002 | Endo et al. | 399/349 |
| 7,593,665 | B2 * | 9/2009 | Hamada et al. | 399/101 |

FOREIGN PATENT DOCUMENTS

| | | | |
|---|---|---|---|
| JP | 01-206379 | A | 8/1989 |
| JP | 01-206387 | A | 8/1989 |
| JP | 2002-082530 | A | 3/2002 |

* cited by examiner

*Primary Examiner* — Hoan Tran
(74) *Attorney, Agent, or Firm* — Global IP Counselors, LLP

(57) ABSTRACT

A cleaning apparatus includes a first cleaning roller, and a second cleaning roller. The first cleaning roller is contrived to contact to a circumferential surface against a moving member to be cleaned and to apply a bias to the member to be cleaned while rotating such that the circumferential surface of the first cleaning roller moves in a same direction as the member to be cleaned moves. The second cleaning roller is contrived to contact to the member to be cleaned after the member has been cleaned by the first cleaning roller and to rotate such that a circumferential surface of the second cleaning roller moves in a direction opposite a direction in which the member being cleaned moves.

7 Claims, 5 Drawing Sheets

CLEANING APPARATUS AND IMAGE FORMING APPARATUS

CROSS-REFERENCE TO RELATED APPLICATIONS

This application claims priority to Japanese Patent Application No. 2010-102210 filed on Apr. 27, 2010. The entire disclosure of Japanese Patent Application No. 2010-102210 is hereby incorporated herein by reference.

BACKGROUND

1. Technical Field

The present invention relates to a cleaning apparatus and an image forming apparatus contrived to use a liquid developer including a carrier liquid and a toner.

2. Background Technology

Technologies have been disclosed for removing a liquid ring produced when an intermediate transfer belt, a photoreceptor, or other image carrier is cleaned in an image forming apparatus that uses a liquid developer (Patent Document 1 and Patent Document 2).

The image forming apparatus recited in Patent Document 1 is contrived to recover a liquid ring formed on a belt with a removal blade, guide the liquid with a wedge shaped liquid guide member so as to transfer the liquid to a removed liquid conveying roller, and remove the liquid from the surface of the roller with a scraper.

The image forming apparatus recited in Patent Document 2 is contrived to remove a liquid ring formed on a photoreceptor using a wedge shaped blade.

[Patent Document 1]: Japanese Laid-open Patent Application No. 2002-82530

[Patent Document 2]: Japanese Laid-open Patent Application No. 1-206387

SUMMARY

Problems to be Solved by the Invention

With the technologies presented in Patent Document 1 and Patent Document 2, depending on a thickness of the blade used to remove the liquid, the liquid on the belt or the photoreceptor sometimes flows along the blade toward an outward side. More specifically, since the liquid being removed has a prescribed degree of viscosity, the liquid on the belt or photoreceptor sometimes hits a face of the blade that includes a thickness dimension of the blade and migrates along that face toward an outward side in a direction perpendicular to the rotation direction of the belt or the photoreceptor. Liquid that flows in this way ends up forming a liquid ring on the belt or photoreceptor again. In a developing apparatus having independent colors, a dirty liquid ring formed after cleaning can become intermixed with colors and cause the image quality to decline.

One of the advantages of some aspects of the invention is to provide an image forming apparatus and a cleaning apparatus capable of cleaning an image carrier by removing a liquid ring from the image carrier appropriately.

Means Used to Solve the Above-Mentioned Problems

A cleaning apparatus according an aspect of the invention has a first cleaning roller and a second cleaning roller. The first cleaning roller is contrived to contact to a circumferential surface against a moving member to be cleaned and apply a bias to the member to be cleaned such that the circumferential surface of the first cleaning roller moves in the same direction as the member to be cleaned moves. The second cleaning roller is contrived to contact to the member to be cleaned after the member has been cleaned by the first cleaning roller and rotate such that a circumferential surface of the second cleaning roller moves in a direction opposite the direction in which the member being cleaned moves.

An image forming apparatus according to an aspect of the invention includes: a latent image carrier contrived for a latent image to be formed thereon; a charging section contrived to electrically charge the latent image carrier; a exposure section contrived to form a latent image by exposing light onto the latent image carrier after the latent image carrier has been charged by the charging section; a developing section contrived to develop a latent image formed on the latent image carrier using a liquid developer containing a toner and a carrier liquid; an image carrier contrived to have an image developed on the latent image carrier transferred thereto and to move while carrying the transferred image; a transfer section contrived to transfer an image carried on the image carrier to a transfer medium; and a cleaning section having a first cleaning roller and a second cleaning roller, the first cleaning roller being contrived to contact to a circumferential surface against the image carrier after the image carrier has transferred an image to the transfer medium at the transfer section and to apply a bias to the image carrier while rotating such that the circumferential surface of the first cleaning roller moves in the same direction as the image carrier moves and the second cleaning roller being contrived to contact to the image carrier after the image carrier has been cleaned by the first cleaning roller and rotate such that a circumferential surface of the second cleaning roller moves in a direction opposite the direction in which the image carrier moves.

In another aspect of an image forming apparatus according to an aspect of the invention, the rotational surface speed of the circumferential surface of the second cleaning roller is larger than the movement speed of the image carrier.

In another aspect of an image forming apparatus according to the invention, the apparatus has a cleaning blade contrived to contact to and clean the second cleaning roller. Also, a length of the second cleaning roller in an axial direction is longer than a length of the image carrier in a direction perpendicular to a movement direction, and a contact width between the cleaning blade and the second cleaning roller along an axial direction of the second cleaning roller is longer than a contact width between the second cleaning roller and the image carrier.

In another aspect of an image forming apparatus according to the invention, the apparatus has an image carrier cleaning blade contrived to contact to the image carrier after the image carrier has been cleaned by the first cleaning roller. Also, a contact width between the image carrier cleaning blade and the image carrier along a direction perpendicular to a movement direction of the image carrier is longer than a contact width between the first cleaning roller and the image carrier, and a width of the image carrier cleaning blade in a direction perpendicular to a movement direction of the image carrier is shorter than a width of the image carrier.

In another aspect of an image forming apparatus according to the invention, the apparatus has a load torque detecting section contrived to detect a load torque occurring when the image carrier is moved and a control section contrived to control a rotational surface speed of a circumferential surface of the first cleaning roller based on a value detected by the load torque detecting section.

In another aspect of an image forming apparatus according to the invention, the control section is contrived to rotate the first cleaning roller at a first rotational surface speed when a value detected by the load torque detecting section is a first load torque and to rotate the first cleaning roller at a second rotational surface speed that is faster than the first rotational surface speed when a value detected by the load torque detecting section is a second load torque that is higher than higher than the first load torque.

In another aspect of an image forming apparatus according to the invention, the second cleaning roller is contrived to apply a bias having a polarity opposite a polarity of a bias applied to the image carrier by the first cleaning roller.

A cleaning apparatus according to the invention has a first cleaning roller and a second cleaning roller. The first cleaning roller is contrived to contact to a circumferential surface against a moving member to be cleaned and apply a bias to the member to be cleaned while the circumferential surface of the first cleaning roller is moved in the same direction as the member to be cleaned moves. The second cleaning roller is contrived to contact to the member to be cleaned after the member has been cleaned by the first cleaning roller while a circumferential surface of the second cleaning roller is moved in a direction opposite the direction in which the member being cleaned moves. Thus, the member to be cleaned is cleaned twice and, furthermore, the second cleaning roller applies a large resistance force against residual toner and carrier liquid. As a result, the cleaning performance can be improved and the occurrence of a liquid ring can be reduced.

An image forming apparatus according to an aspect of the invention includes: a latent image carrier contrived to have a latent image formed thereon; a charging section contrived to electrically charge the latent image carrier; an exposure section contrived to form a latent image by exposing light onto the latent image carrier after the latent image carrier has been charged by the charging section; a developing section contrived to develop a latent image formed on the latent image carrier using a liquid developer containing a toner and a carrier liquid; an image carrier contrived to have an image developed on the latent image carrier is transferred thereto and to move while carrying the transferred image; a transfer section contrived to transfer an image carried on the image carrier to a transfer medium; and a cleaning section having a first cleaning roller and a second cleaning roller, the first cleaning roller being contrived to contact to a circumferential surface against the image carrier after the image carrier has transferred an image to the transfer medium at the transfer section and to apply a bias to the image carrier while the circumferential surface of the first cleaning roller moves in the same direction as the image carrier moves, and the second cleaning roller being contrived to contact to the image carrier after the image carrier has been cleaned by the first cleaning roller and move such that a circumferential surface of the second cleaning roller moves in a direction opposite the direction in which the image carrier moves. Thus, the member to be cleaned is cleaned twice and, furthermore, the second cleaning roller applies a large resistance force against residual toner and carrier liquid. As a result, the cleaning performance can be improved, the occurrence of a liquid ring can be reduced, and the image quality can be improved.

In another aspect of the invention, since the rotational surface speed of the second cleaning roller is larger than the movement speed of the image carrier, an amount of residual toner and carrier liquid scraped off per unit time by the second cleaning roller does not depend on the type of toner, the amount of time elapsed, or other factors causing the viscosity to vary and is larger than an amount of residual toner and carrier liquid that flows to the second cleaning roller per unit time. Thus, the amount of residual toner and carrier liquid stagnating at a portion where the second cleaning roller and the image carrier contact each other is reduced. As a result, a degree to which a drive performance of the image carrier declines due to residual toner and carrier liquid is reduced.

In another aspect of the invention, the apparatus has a cleaning blade contrived to contact to and clean the second cleaning roller. Also, a length of the second cleaning roller in an axial direction is longer than a length of the image carrier in a direction perpendicular to a movement direction, and a contact width between the cleaning blade and the second cleaning roller along an axial direction of the second cleaning roller is longer than a contact width between the second cleaning roller and the image carrier. As a result, when the second cleaning roller is cleaned with the second cleaning roller cleaning blade, even if carrier liquid collects at both ends of the second cleaning roller cleaning blade, the place where the carrier liquid collects does not migrate outward beyond the image carrier in an axial direction and the occurrence of carrier liquid adhering to the image carrier is reduced.

In another aspect of the invention, the apparatus has an image carrier cleaning blade contrived to contact to the image carrier after the image carrier has been cleaned by the first cleaning roller. Also, a contact width between the image carrier cleaning blade and the image carrier along a direction perpendicular to a movement direction of the image carrier is longer than a contact width between the first cleaning roller and the image carrier, and a width of the image carrier cleaning blade in a direction perpendicular to a movement direction of the image carrier is shorter than a width of the image carrier. Thus, the member to be cleaned is cleaned three times and the cleaning performance is improved. Since the cleaning performance obtained with the image carrier cleaning blade is high, the cleaning performance of the second cleaning roller is not critical and the cost can be held low.

In another aspect of the invention, the apparatus has a load torque detecting section contrived to detect a load torque occurring when the image carrier is moved and a control section contrived to control a rotational surface speed of a circumferential surface of the first cleaning roller based on a value detected by the load torque detecting section. As a result, the load torque acting on the image carrier can be adjusted and an appropriate rotational surface speed relationship can be obtained.

In another aspect the invention, the control section is contrived to rotate the first cleaning roller at a first rotational surface speed when a value detected by the first load torque detecting section is a first load torque and to rotate the first cleaning roller at a second rotational surface speed that is faster than the first rotational surface speed when a value detected by the load torque detecting section is a second load torque that is higher than higher than the first load torque. As a result, the load torque acting on the image carrier can be reduced.

In another aspect of the invention, the second cleaning roller is contrived to apply a bias having a polarity opposite the polarity of a bias applied to the image carrier by the first cleaning roller. As a result, toner that was not cleaned by the first cleaning roller and remained on the image carrier injected with electric charge can be removed by being attracted with the opposite electric polarity.

DETAILED DESCRIPTION OF EXEMPLARY EMBODIMENTS

Embodiments of the invention will now be explained with reference to the drawings.

Figure 1:
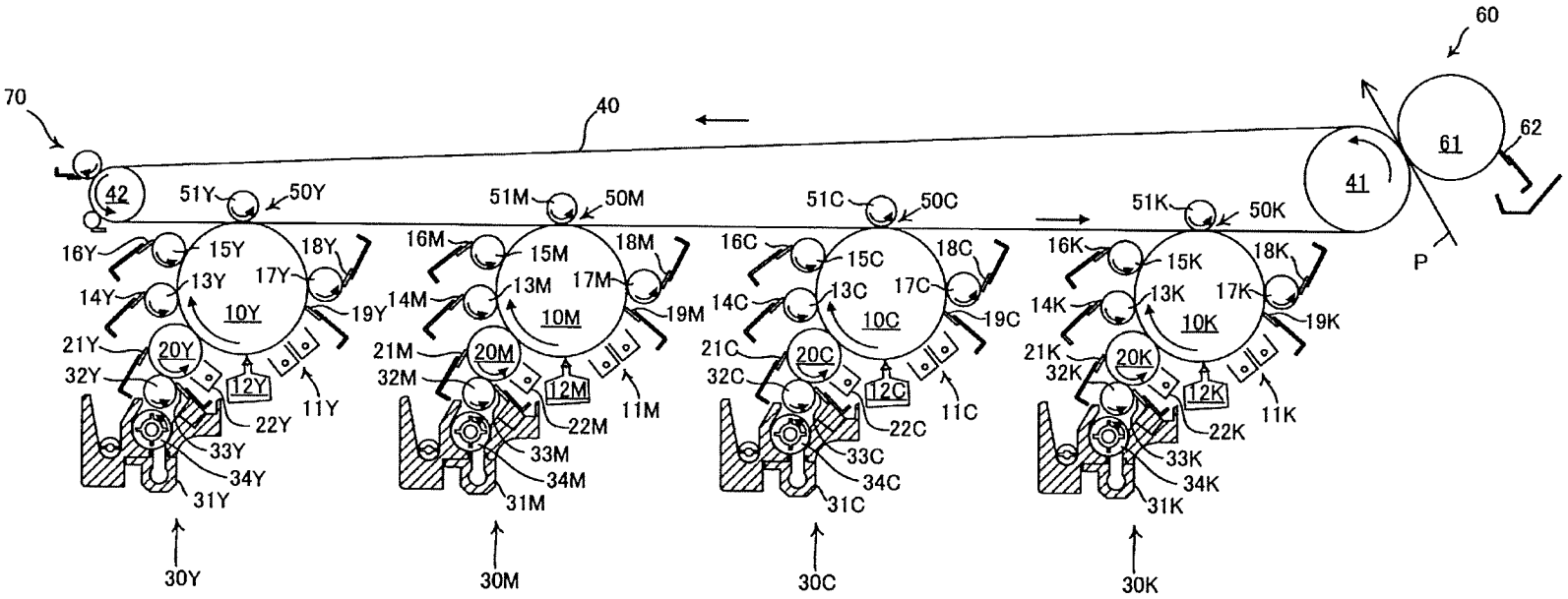
FIG. 1 shows an embodiment of an image forming apparatus.

FIG. 1 shows the main constituent components of an image forming apparatus according to an embodiment of the invention. The image forming apparatus has developing devices 30Y, 30M, 30C, and 30K serving as developing sections and contrived to develop electrostatic latent images formed on photoreceptors 10Y, 10M, 10C, and 10K (serving as latent image carriers) using color-specific liquid developer for the colors yellow (Y), magenta (M), cyan (C), and black (K). After passing through a primary transfer section 50 and an intermediate transfer belt 40 exemplifying a member to be cleaned or an image carrier, the developed images are transferred to a transfer material at a secondary transfer section 60, thereby forming an image. The order in which the photoreceptors 10Y, 10M, 10C, and 10K and the developing devices 30Y, 30M, 30C, and 30K corresponding to the respective colors Y, M, C, and K are arranged is not limited to the example shown in FIG. 1; any order is acceptable.

The following components are arranged surrounding each of the photoreceptors 10Y, 10M, 10C, and 10K: a corona charging device 11Y, 11M, 11C, or 11K serving as a charging section; an exposure unit 12Y, 12M, 12C, or 12K serving as an exposure section; a development roller 20Y, 20M, 20C, or 20K of the developing device 30Y, 30M, 30C, or 30K; a squeezing device; a primary transfer section 50Y, 50M, 50C, or 50M; a photoreceptor cleaning roller 17Y, 17M, 17C, or 17K; and a photoreceptor cleaning blade 19Y, 19M, 19C, or 19K. Among the components just listed in order from the corona charging device 11Y, 11M, 11C, 11K to the photoreceptor cleaning blade 19Y, 19M, 19C, 19K, the components listed earlier are defined to be arranged farther upstream in the image forming process than components listed later.

Each of the photoreceptors 10Y, 10M, 10C, and 10K is a photoreceptor drum including a cylindrical member and a photoreceptor layer made of an amorphous silicon photoreceptor or the like formed on an outer circumferential surface of the cylindrical member. From the perspective of FIG. 1, the photoreceptors 10Y, 10M, 10C, and 10K rotate in a clockwise direction.

The surface of each photoreceptor 10Y, 10M, 10C, and 10K is charged by a corona charging device 11Y, 11M, 11C, or 11K at a position upstream from a nip portion existing between the photoreceptor 10Y, 10M, 10C, or 10K and the development roller 20Y, 20M, 20C, or 20K. A voltage is applied to the corona charging device 11Y, 11M, 11C, or 11K from a power source not shown in the drawings. After the surface of the photoreceptor 10Y, 10M, 10C, or 10K is charged, a latent image is formed on the surface by the exposure unit 12Y, 12M, 12C, or 12K. The latent image on the photoreceptor 10Y, 10M, 10C, or 10K is then developed by the developing device 30Y, 30M, 30C, or 30K.

Each of the developing devices 30Y, 30M, 30C, or 30K includes the following components: a development roller 20Y, 20M, 20C, or 20K contrived to carry a liquid developer; an anilox roller 32Y, 32M, 32C, or 32K contrived to coat the development roller 20Y, 20M, 20C, or 20K with the liquid developer, thus serving as a coating roller that functions as a liquid developer supplying member; a regulating blade 33Y, 33M, 33C, or 33K contrived to regulate the amount of liquid developer coated onto the development roller 20Y, 20M, 20C, or 20K to a prescribed amount; an auger 34Y, 34M, 34C, or 34K contrived to agitate and transport the liquid developer while supplying the liquid developer to the anilox roller 32Y, 32M, 32C, or 32K; a compaction corona generating device 22Y, 22M, 22C, 22K contrived to put the liquid developer carried on the development roller 20Y, 20M, 20C, and 20K into a compacted state; a development roller cleaning blade 21Y, 21M, 21C, and 21K contrived to cleaning the development roller 20Y, 20M, 20C, and 20K; and a developer container 31Y, 31M, 31C, and 31K contrived to store a liquid development agent including a toner dispersed in a carrier at ratio of approximately 20% by weight.

The liquid developer contained in developer containers 31Y, 31M, 31C, and 31K is not a typically used volatile liquid developer that uses Isopar (trade name, made by Exxon) as a carrier liquid, has a low concentration (approximately 1 to 3 wt %) and a low viscosity, and is volatile at a room temperature. Instead, the liquid developer stored in the developer storage section is a high-concentration, high-viscosity, non-volatile liquid developer that is not volatile at room temperature. More specifically, the liquid developer used in the invention includes solid particles added to a liquid solvent along with a dispersant. The solid particles have an average particle size of 1 μm and are made of a thermoplastic resin having a pigment or other colorant dispersed therein, and the liquid solvent is an organic solvent, a silicon oil, a mineral oil, a cooking oil, or other liquid solvent. The liquid developer has a concentration of solid toner of approximately 15 to 25% and the viscosity of the liquid developer is high (using a HAAKE RheoStress 600, the viscous elasticity is approximately 30 to 300 mPa·s at a temperature of 25° C. and a shear velocity of 1000 (1/s)).

A squeezing device is arranged in a position downstream of a nip portion between the photoreceptor 10Y, 10M, 10C, 10K and the development roller 20Y, 20M, 20C, 20K in a rotational direction of the photoreceptor 10Y, 10M, 10C, 10K. The squeezing device is arranged facing the photoreceptor 10Y, 10M, 10C, and 10K and serves to recover excess carrier liquid of the toner image developed on the photoreceptor 10Y, 10M, 10C, 10K. The squeezing device includes the following: a first squeezing roller 13Y, 13M, 13C, 13K made of an elastic roller material and arranged to rotate while in sliding contact with the photoreceptor 10Y, 10M, 10C, 10K; a first squeezing roller cleaning blade 14Y, 14M, 14C, 14K contrived to clean the first squeezing roller 13Y, 13M, 13C, 13K; a second squeezing roller 15Y, 15M, 15C, 15K made of an elastic roller material and arranged to rotate while in sliding contact with the photoreceptor 10Y, 10M, 10C, 10K; and a second squeezing roller cleaning blade 16Y, 16M, 16C, 16K contrived to clean the second squeezing roller 15Y, 15M, 15C, 15K. The squeezing device functions to recover excess carrier liquid and unnecessary fog toner from the toner image developed on the photoreceptor 10Y, 10M, 10C, 10K and increase a toner particle ratio inside the toner image. A prescribed bias voltage is applied to the first squeezing roller 13Y, 13M, 13C, 13K and the second squeezing roller 15Y, 15M, 15C, 15K.

After passing through the squeezing device, the surface of the photoreceptor 10Y, 10M, 10C, 10K enters the primary transfer section 50Y, 50M, 50C, and 50K. The primary transfer section 50Y, 50M, 50C, 50K serves to transfer a toner image formed on the photoreceptor 10Y, 10M, 10C, 10K to the intermediate transfer belt 40 at a nip section between the photoreceptor 10Y, 10M, 10C, 10K and a primary transfer roller 51Y, 51M, 51C, 51K.

After passing through the primary transfer section 50Y, 50M, 50C, 50K, the surface of the photoreceptor 10Y, 10M, 10C, 10K contacts to the photoreceptor cleaning roller 16Y, 16M, 16C, 16K. The photoreceptor cleaning roller 17Y, 17M, 17C, 17K contacts to the photoreceptor 10Y, 10M, 10C, 10K and rotates counterclockwise, thereby cleaning residual liquid developer left over after the transfer and un-transferred liquid developer from the photoreceptor body 10Y, 10M, 10C, 10K. A bias voltage is applied to the photoreceptor cleaning roller 17Y, 17M, 17C, 17K to attract toner particles contained in the liquid developer. The photoreceptor cleaning roller 17Y, 17M, 17C, 17K is cleaned by a photoreceptor cleaning roller cleaning blade 18Y, 18M, 18C, 18K.

A photoreceptor cleaning blade 19Y, 19M, 19C, 19K is arranged downstream of the photoreceptor cleaning roller 17Y, 17M, 17C, 17K such that it contacts the photoreceptor 10Y, 10M, 10C, 10K and serves to clean the photoreceptor 10Y, 10M, 10C, 10K by scraping off liquid developer.

The intermediate transfer belt 40 is a belt made of seamless rubber or another elastic material. The intermediate transfer belt 40 is arranged to span between a belt driving roller 41 and a tension roller 42 in a tensioned state and is driven by the belt driving roller 41 while contacting the photoreceptors 10Y, 10M, 10C and 10K at the primary transfer sections 50Y, 50M, 50C, and 50K.

At the primary transfer sections 50Y, 50M, 50C, and 50K, the photoreceptors 10Y, 10M, 10C, and 10K and the primary transfer rollers 51Y, 51M, 51C, and 51K are arranged opposite one another such that they pinch the intermediate transfer belt 40. The positions where the photoreceptors 10Y, 10M, 10C, and 10K contact the intermediate transfer belt 40 are transfer positions where the developed images on the photoreceptors 10Y, 10M, 10C, and 10K are transferred to the intermediate transfer belt 40 in succession such that the different color toner images are overlaid on one another to form a full color toner image.

The belt driving roller 41 and the tension roller 42 serve to tension the intermediate transfer belt 40 and the belt driving roller 41 drives the intermediate transfer belt 40 such that it rotates. A transfer belt cleaning section 70 serving as an image carrier cleaning device or an image carrier cleaning section is provided in a location where the intermediate transfer belt 40 wraps around the tension roller 42.

The secondary transfer section 60 includes a secondary transfer roller 61. The secondary transfer roller 61 is rotates in the direction indicated by an arrow in response to rotation of the belt driving roller 41, and a transfer bias is applied to the secondary transfer roller 61 such that the toner image carried on the intermediate transfer belt 40 is transferred at a transfer nip to a sheet of paper, film, cloth, or another transfer material that is conveyed along a transfer material conveying path P. The secondary transfer section 60 also includes a secondary transfer roller cleaning blade 62 serving to clean the secondary transfer roller 61 and a transfer roller cleaning blade support member.

A transfer material conveying device (not shown) is arranged along the transfer material conveying path P downstream of the secondary transfer section 60 such that the transfer material is conveyed to a fixing unit (not shown). At the fixing unit, the monochromatic toner image or full color toner image transferred to the transfer material (paper or the like) is fixed to the transfer material by being fused to the transfer material.

The transfer material is supplied to the image forming apparatus by a paper supplying device (not shown). The transfer material set in the paper supplying device is fed to the transfer material conveying path P one sheet at a time at a prescribed timing.

A transfer belt cleaning section 70 according to a first embodiment will now be explained in detail.

Figure 2:
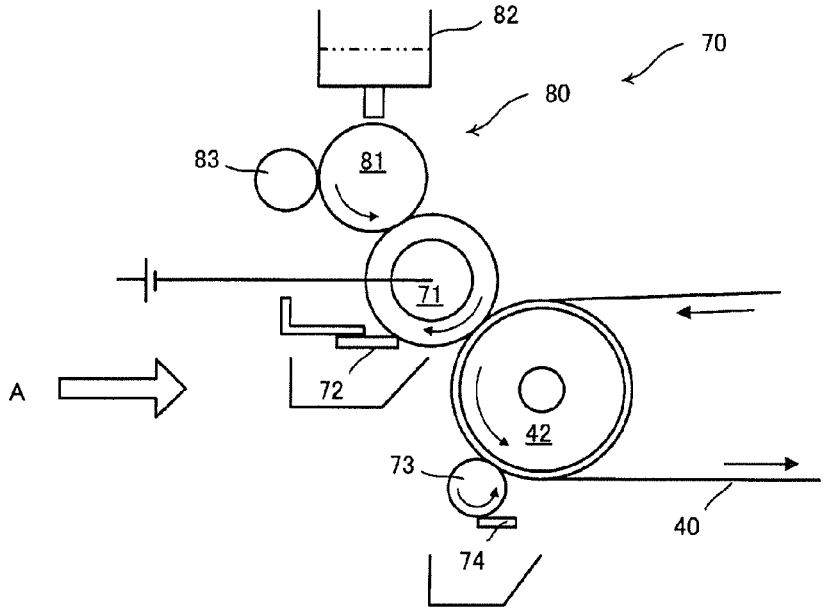
FIG. 2 shows a transfer belt cleaning section according to a first embodiment.
Figure 3:
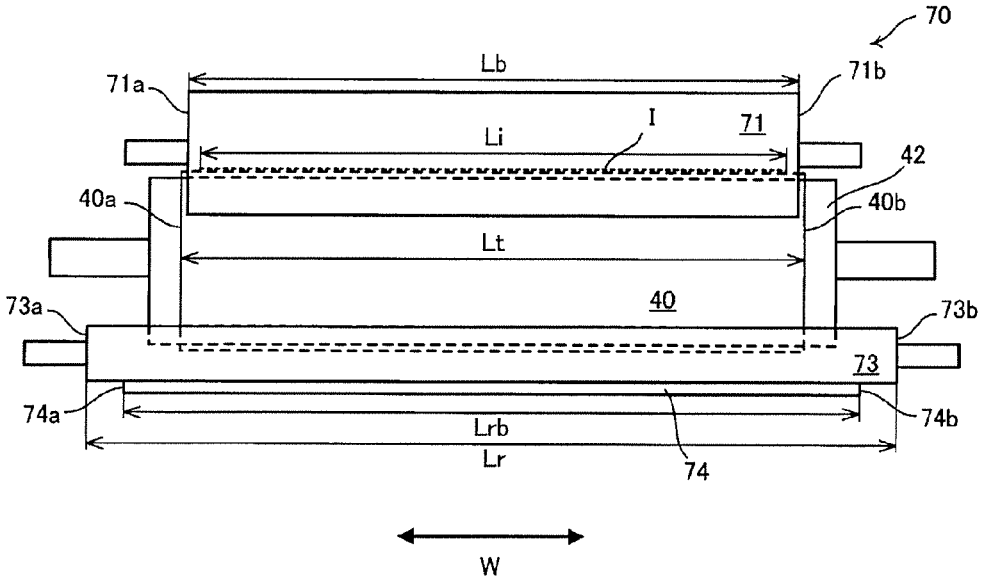
FIG. 3 shows the transfer belt cleaning section as viewed from the direction of an arrow A shown in FIG. 2.

FIG. 2 shows transfer belt cleaning section 70 according to a first embodiment and FIG. 3 shows the transfer belt cleaning section 70 as viewed from the direction of an arrow A shown in FIG. 2. In FIG. 3, a bias cleaning roller cleaning blade 72 is omitted. In FIG. 3, the arrow W indicates an axial direction of the bias cleaning roller 71 and a reverse rotation cleaning roller 73 as well as a movement direction of the intermediate transfer belt 40.

The transfer belt cleaning section 70 includes: a bias cleaning roller 71 that serves a first cleaning roller, is arranged such that a circumferential surface thereof contacts to the moving intermediate transfer belt 40, rotates such that its circumferential surface moves in the same direction as the intermediate transfer belt 40 at a nip location where the bias cleaning roller 71 contacts to the intermediate transfer belt 40, and is contrived to apply a bias to the intermediate transfer belt 40; a bias cleaning roller cleaning blade 72 serving as a first cleaning roller cleaning blade contrived to scrape residual toner and carrier liquid off the bias cleaning roller 71; a reverse rotation cleaning roller 73 that serves as a second cleaning roller, is arranged such that a circumferential surface thereof contacts to the intermediate transfer belt 40 at a position downstream of where the bias cleaning roller 71 contacts to the intermediate transfer belt 40, and is contrived to rotate such that its circumferential surface moves in an opposite direction as the intermediate transfer belt 40 at a nip location where the reverse rotation cleaning roller 73 contacts to the intermediate transfer belt 40; a reverse rotation cleaning roller cleaning blade 74 serving as a second cleaning roller cleaning blade contrived to scrape residual toner and carrier liquid off the reverse rotation cleaning roller 73; and a liquid coating section 80 contrived to coat the bias cleaning roller 71 with a carrier liquid.

The liquid coating section 80 includes: a coating roller 81 that is arranged such that a circumferential surface thereof contacts to the bias cleaning roller 71 at a nip location, rotated such that its circumferential surface moves in the same direction as the bias cleaning roller 71 at the nip location, and serves to coat the bias cleaning roller 71 with the carrier liquid; a carrier liquid supplying section 82 serving as a liquid supplying section contrived to supply the carrier liquid to the coating roller 81; and a preparation roller 83 contrived to disperse the carrier liquid supplied to the coating roller 81 by the carrier liquid supplying section 82 across the circumferential surface of the coating roller 81 in an axial direction of the bias cleaning roller 71 before the coating roller 81 coats the bias cleaning roller 71.

The bias cleaning roller 71 cleans residual toner and carrier liquid from the intermediate transfer belt 40 by applying a bias to the intermediate transfer belt 40 while rotating clockwise along with the tension roller 42 when viewed from the perspective of FIG. 2 such that its circumferential surface moves in the same direction as the intermediate transfer belt 40 at a nip position between the bias cleaning roller 71 and the tension roller 42. Additionally, the residual toner and carrier liquid moved to the bias cleaning roller 71 are scraped off by the bias cleaning roller cleaning blade 72.

The reverse rotation cleaning roller 73 rotates in the opposite direction as the bias cleaning roller 71, i.e., counterclockwise from the perspective of FIG. 2, at a rotational surface speed that is faster than the movement speed of the intermediate transfer belt 40. The reverse rotation cleaning roller 73 contacts to the intermediate transfer belt 40 at a nip position where a nip is formed between the reverse rotation cleaning roller 73 and the tension roller 42 downstream from where the intermediate transfer belt 40 is cleaned by the bias cleaning roller 71. At the location where it contacts to the intermediate transfer belt 40, the circumferential surface of the reverse rotation cleaning roller 73 moves in the opposite direction as the intermediate transfer belt 40 and cleans toner and carrier liquid left by the bias cleaning roller 71. Additionally, the residual toner and carrier liquid moved to the reverse rotation cleaning roller 73 are scraped off by the reverse rotation cleaning roller cleaning blade 74. The rotational surface speed of the reverse rotation cleaning roller 73 is defined to be positive when the reverse rotation cleaning roller 73 is rotating counterclockwise from the perspective of FIG. 2, and the movement speed of the intermediate transfer belt 40 is defined to be positive when the intermediate transfer belt 40 is moving in the movement direction indicated in FIG. 2.

As explained previously, the transfer belt cleaning section 70 has a bias cleaning roller 71 contrived to contact to the intermediate transfer belt 40 and apply a bias while rotating such that its circumferential surface moves in the same direction as the intermediate transfer belt 40 at the place where it contacts to the intermediate transfer belt 40 and a reverse rotation cleaning roller 73 contrived to contact to the intermediate transfer belt 40 at a position located downstream from where the intermediate transfer belt 40 is cleaned by the bias cleaning roller 71 and rotate such that its circumferential surface moves in the opposite direction as the intermediate transfer belt 40 at the place where it contacts to the intermediate transfer belt 40. Thus, the intermediate transfer belt 40 is cleaned twice and the reverse rotation cleaning roller 73 applies a large resistance force against the toner and carrier liquid remaining on the intermediate transfer belt 40. As a result, the cleaning performance can be improved and the occurrence of a liquid ring can be reduced.

If the rotational surface speed of the reverse rotation cleaning roller 73 is smaller than the rotational surface speed of the intermediate transfer belt 40, then the residual toner and carrier liquid transferred to the reverse rotation cleaning roller 73 will tend to collect at a portion where the reverse rotation cleaning roller 73 and the intermediate transfer belt 40 contact each other and the collected residual toner and carrier liquid will gradually spread in the axial direction of the reverse rotation cleaning roller 73. After it has spread in the axial direction of the reverse rotation cleaning roller 73, the residual toner and carrier liquid sometimes migrates around to the back side of the intermediate transfer belt 40 and causes the drive performance of the intermediate transfer belt 40 to decline. This tendency is particularly marked when the viscosity of the toner is high.

In this embodiment, however, the rotational surface speed of the reverse rotation cleaning roller 73 is larger than the movement speed of the intermediate transfer belt 40. Since the rotational surface speed of the reverse rotation cleaning roller 73 is larger than the movement speed of the intermediate transfer belt 40, an amount of residual toner and carrier liquid scraped off per unit time by the reverse rotation cleaning roller 73 does not depend on the type of toner, the amount of time elapsed, or other factors causing the viscosity to vary and is larger than an amount of residual toner and carrier liquid that flows to the reverse rotation cleaning roller 73 per unit time. Thus, the amount of residual toner and carrier liquid stagnating at a portion where the reverse rotation cleaning roller and the intermediate transfer belt 40 contact each other is reduced. As a result, the tendency of the residual toner and carrier liquid to migrate to the back side of the intermediate transfer belt 40 and cause the drive performance of the intermediate transfer belt 40 to decline is reduced.

At the liquid coating section 80, the carrier liquid supplied to a circumferential surface of the coating roller 81 by the carrier liquid supplying section 82 is distributed uniformly along the axial direction of the coating roller 81 by the preparation roller 83 and, then, the distributed carrier liquid is coated onto the bias cleaning roller 71 by the coating roller 81.

Thus, since carrier liquid is added from the liquid coating section 80, the amount of carrier liquid at the nip portion between the bias cleaning roller 71 and the intermediate transfer belt 40 wrapped around the tension roller 42 increases, thus enabling toner to move more readily and more efficiently.

The relationships among the length of the intermediate transfer belt 40 in a direction perpendicular to the movement direction, the axial length of the rollers of the transfer belt cleaning section 70, and the lengths of the blades in the axial direction of the rollers will now be explained. In FIG. 3, Lt is the length of the intermediate transfer belt 40 in a direction perpendicular to the movement direction, i.e., the length between a first edge portion 40*a* and a second edge portion 40*b* along a direction perpendicular to the movement direction, Li is a length of an image I formed on the intermediate transfer belt 40 in a direction perpendicular to the movement direction, Lb is a length of the bias cleaning roller 71 in an axial direction of the bias cleaning roller 71, i.e., an axial length between a first end portion 71*a* and a second end portion 71*b*, Lr is a length of the reverse rotation cleaning roller 73 in an axial direction of the reverse rotation cleaning roller 73, i.e., an axial length between a first end portion 73*a* and a second end portion 73*b*, Lrb is a length of the reverse rotation cleaning roller cleaning blade 74 in an axial direction of the reverse rotation cleaning roller 73, i.e., an axial length between a first end portion 74*a* and a second end portion 74*b*.

In the first embodiment, the axial length Lr of the reverse rotation cleaning roller 73 and the axial length Lrb of the reverse rotation cleaning roller cleaning blade 74 are longer than the length Lt of the intermediate transfer belt 40 in a direction perpendicular to its movement direction.

More specifically, the lengths satisfy the equation (1) shown below.

$$Li<Lb<Lt<Lrb<Lr \quad (1)$$

For example, the length Li of an image I in a direction perpendicular to the movement direction of the intermediate transfer belt 40 could be set to 325 mm (Li=325 mm), the axial length Lb of the bias cleaning roller 71 could be set to 340 mm (Lb=340 mm), the length Lt of the intermediate transfer belt 40 in a direction perpendicular to its movement direction might be set to 374 mm (Lt=374 mm), the length Lrb of the reverse rotation cleaning roller cleaning blade 74 in an axial direction of the reverse rotation cleaning roller 73 could be set to 384 mm (Lrb=384 mm), and the axial length Lr of the reverse rotation cleaning roller 73 could be 394 mm (Lr=394 mm).

By making the axial length Lr of the reverse rotation cleaning roller 73 and the length Lrb of the reverse rotation cleaning roller cleaning blade 74 in the axial direction of the reverse rotation cleaning roller 73 longer than the length Lt of the intermediate transfer belt 40 in a direction perpendicular to its movement direction, even if carrier liquid collects at both ends of the reverse rotation cleaning roller cleaning blade 74 when the reverse rotation cleaning roller 73 is cleaned by the reverse rotation cleaning roller cleaning blade 74, the place where the carrier liquid collects will be located outward in the axial direction beyond the intermediate transfer belt 40 and, thus, the adhesion of carrier liquid to the intermediate transfer belt 40 will be reduced.

A transfer belt cleaning section 70 exemplifying an image carrier cleaning device according to a second embodiment will now be explained in detail.

Figure 4:
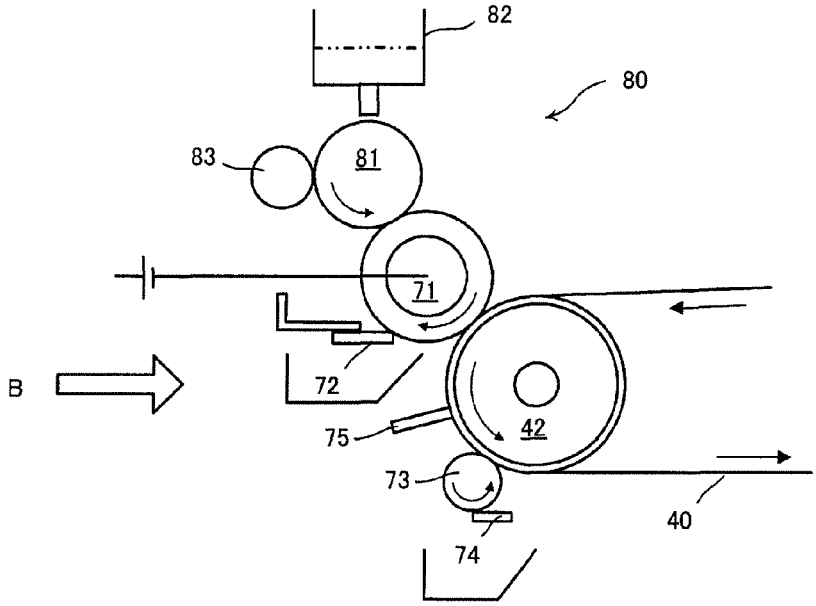
FIG. 4 shows a transfer belt cleaning section of a second embodiment.
Figure 5:
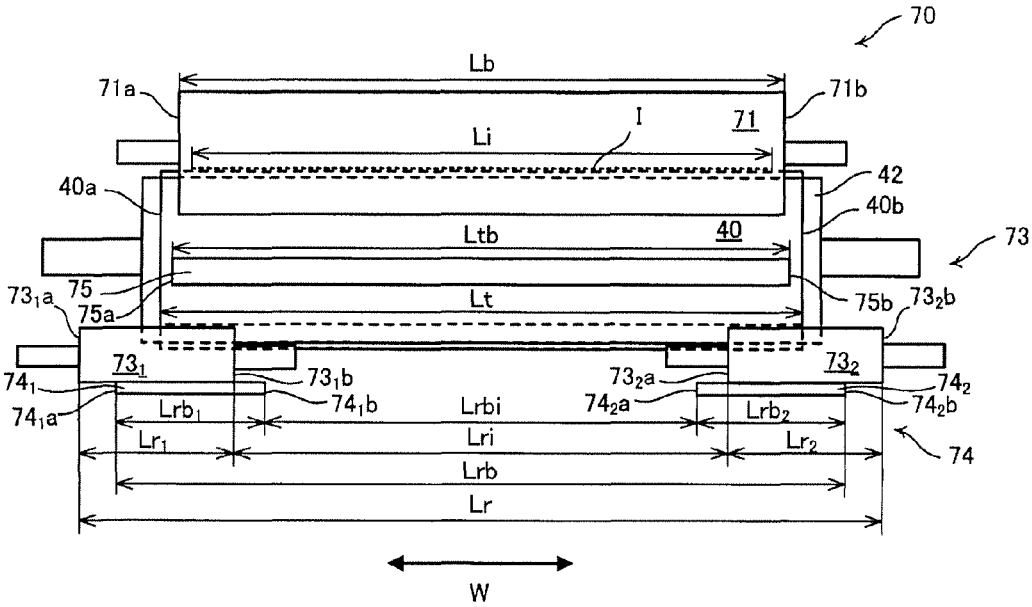
FIG. 5 shows the transfer belt cleaning section as viewed from the direction of an arrow B shown in FIG. 4.

FIG. 4 shows transfer belt cleaning section 70 according to a second embodiment, and FIG. 5 shows the transfer belt cleaning section 70 as viewed from the direction of an arrow B shown in FIG. 4. In FIG. 5, a bias cleaning roller cleaning blade 72 is omitted. An arrow W in FIG. 5 indicates an axial direction of the rollers and will be referred to as the "axial direction" in the following explanation.

The transfer belt cleaning section 70 includes: a bias cleaning roller 71 serving as a first cleaning roller contrived to clean the intermediate transfer belt 40 by contacting to a circumferential surface against the intermediate transfer belt 40 at a nip location, rotating such that its circumferential surface moves in the same direction as the intermediate transfer belt 40 at the nip location, and applying a bias to the intermediate transfer belt 40; a bias cleaning roller cleaning blade 72 serving as a first cleaning roller cleaning blade contrived to scrape residual toner and carrier liquid off the bias cleaning roller 71; a reverse rotation cleaning roller 73 serving as a second cleaning roller contrived to clean the intermediate transfer belt 40 after the intermediate transfer belt 40 has been cleaned by the bias cleaning roller 71 by contacting to a circumferential surface against the intermediate transfer belt 40 at a nip location and rotating such that its circumferential surface moves in the opposite direction as the intermediate transfer belt 40 at the nip location; a reverse rotation cleaning roller cleaning blade 74 serving as a second cleaning roller cleaning blade contrived to scrape residual toner and carrier liquid off the reverse rotation cleaning roller 73; a transfer belt cleaning blade 75 serving as a member-to-be-cleaned cleaning blade or an image carrier cleaning blade contrived to scrape residual toner and carrier liquid off the intermediate transfer belt 40; and a liquid coating section 80 contrived to coat the bias cleaning roller 71 with a carrier liquid.

The liquid coating roller 80 has the same constituent features as in the first embodiment.

The biasing-cleaning roller 71 cleans residual toner and carrier liquid from the intermediate transfer belt 40 by applying a bias to the intermediate transfer belt 40 while rotating clockwise along with the tension roller 42 when viewed from the perspective of FIG. 2 such that its circumferential surface moves in the same direction as the intermediate transfer belt 40 at a nip position between the biasing-cleaning roller 71 and the tension roller 42. Additionally, the residual toner and carrier liquid moved to the bias cleaning roller 71 are scraped off by the bias cleaning roller cleaning blade 72.

The transfer blade cleaning blade 75 serves to scrape residual toner and carrier liquid off the intermediate transfer belt 40 after the intermediate transfer belt has been cleaned by the bias cleaning roller 71 and before the intermediate transfer belt 40 has been cleaned by the reverse rotation cleaning roller 73.

The reverse rotation cleaning roller 73 rotates in the opposite direction as the bias cleaning roller 71, i.e., counterclockwise from the perspective of FIG. 2, at a rotational surface speed that is faster than the movement speed of the intermediate transfer belt 40. The reverse rotation cleaning roller 73 contacts to the intermediate transfer belt 40 at a nip position where a nip is formed between the reverse rotation cleaning roller 73 and the tension roller 42 downstream from where the intermediate transfer belt 40 is cleaned by the bias cleaning roller 71. At the location where it contacts to the intermediate transfer belt 40, the circumferential surface of the reverse rotation cleaning roller 73 moves in the opposite direction as the intermediate transfer belt 40 and cleans toner and carrier liquid left by the bias cleaning roller 71. The rotational surface speed of the reverse rotation cleaning roller 73 is defined to be positive when the reverse rotation cleaning roller 73 is rotating counterclockwise from the perspective of FIG. 2, and the movement speed of the intermediate transfer belt 40 is defined to be positive when the intermediate transfer belt 40 is moving in the movement direction indicated in FIG. 2.

The reverse rotation cleaning roller 73 is divided into a first reverse rotation cleaning roller $\mathbf{73}_1$ and a second reverse rotation cleaning roller $\mathbf{73}_2$. The first reverse rotation cleaning roller $\mathbf{73}_1$ serves as a first short cleaning roller arranged to contact to a first end portion 40*a* of the intermediate transfer belt 40, and the second reverse rotation cleaning roller $\mathbf{73}_2$ serves as a second short cleaning roller arranged to contacts to a second end portion 40*b* of the intermediate transfer belt 40. It is acceptable to have one axle and divide only the roller portion. Also, the reverse rotation cleaning roller 73 is not limited to being divided into two sections; it is also acceptable to have one or a plurality of middle sections.

The first reverse rotation cleaning roller $\mathbf{73}_1$ and the second reverse rotation cleaning roller $\mathbf{73}_2$ are arranged opposite the tension roller 42 such that they contacts to the intermediate transfer belt 40 at a position downstream of a nip portion where residual toner and carrier liquid are cleaned from the intermediate transfer belt 40 by the bias cleaning roller 71 and serve to clean toner and carrier liquid that are left unremoved by the bias cleaning roller 71. The residual toner and carrier liquid moved to the first reverse rotation cleaning roller $\mathbf{73}_1$ and the second reverse rotation cleaning roller $\mathbf{73}_2$ are scraped off by a first reverse rotation cleaning roller cleaning blade $\mathbf{74}_1$ provided with respect to the first reverse rotation cleaning roller $\mathbf{73}_1$ and a second reverse rotation cleaning roller cleaning blade $\mathbf{74}_2$ provided with respect to the second reverse rotation cleaning roller $\mathbf{73}_2$.

As explained previously, the intermediate transfer belt 40 is cleaned by the bias cleaning roller 71 which rotates along with the tension roller 42 and cleaned by the first reverse rotation cleaning roller $\mathbf{73}_1$ and the second reverse rotation cleaning roller $\mathbf{73}_2$ which rotate in the opposite direction as the bias cleaning roller 71. Thus, the intermediate transfer belt 40 is cleaned twice and the first reverse rotation cleaning roller $\mathbf{73}_1$ and the second reverse rotation cleaning roller $\mathbf{73}_2$ apply a large resistance force against the toner and carrier liquid remaining on the intermediate transfer belt 40. As a result, the cleaning performance can be improved and the occurrence of a liquid ring can be reduced.

The reverse rotation cleaning roller 73 is divided into a first reverse rotation cleaning roller $\mathbf{73}_1$ arranged to contacts to a first end portion 40*a* of the intermediate transfer belt 40 and a second reverse rotation cleaning roller $\mathbf{73}_2$ arranged to contact to a second end portion 40*b* of the intermediate transfer belt 40. Thus, an middle portion of the intermediate transfer belt 40 between the first end portion 40*a* and the second end portion 40*b* is left uncontacted. As a result, the load produced by the bias cleaning roller 71, the transfer belt cleaning blade 75, and the reverse rotation cleaning roller 73 contacting to the intermediate transfer belt 40 can be reduced.

If the rotational surface speed of the first reverse rotation cleaning roller $\mathbf{73}_1$ and the second reverse rotation cleaning roller $\mathbf{73}_2$ is slower than the rotational surface speed of the intermediate transfer belt 40, then the residual toner and carrier liquid transferred to the first reverse rotation cleaning roller $\mathbf{73}_1$ and the second reverse rotation cleaning roller $\mathbf{73}_2$ will tend to collect at a portion where the reverse rotation cleaning roller 73 and the intermediate transfer belt 40 contact each other and the collected residual toner and carrier liquid will gradually spread in the axial direction of the reverse rotation cleaning roller 73. After it has spread in the aforementioned axial direction, the residual toner and carrier liquid sometimes migrates around to the back side of the intermediate transfer belt 40 and causes the drive performance of the intermediate transfer belt 40 to decline. This tendency is particularly marked when the viscosity of the toner is high.

In this embodiment, however, the rotational surface speed of the first reverse rotation cleaning roller $\mathbf{73}_1$ and the second reverse rotation cleaning roller $\mathbf{73}_2$ constituting the reverse rotation cleaning roller 73 is larger than the movement speed of the intermediate transfer belt 40. Since the rotational surface speed of the first reverse rotation cleaning roller $\mathbf{73}_1$ and the second reverse rotation cleaning roller $\mathbf{73}_2$ is larger than the movement speed of the intermediate transfer belt 40, an amount of toner-containing carrier liquid scraped off per unit time by the first reverse rotation cleaning roller $\mathbf{73}_1$ and the second reverse rotation cleaning roller $\mathbf{73}_2$ does not depend on the type of toner, the amount of time elapsed, or other factors causing the viscosity to vary and is larger than an amount of toner-containing carrier liquid that flows to the reverse rotation cleaning roller 73 per unit time. Thus, the amount of toner-containing carrier liquid that stagnates at a portion where the first reverse rotation cleaning roller $\mathbf{73}_1$ and the second reverse rotation cleaning roller $\mathbf{73}_2$ contact the intermediate transfer belt 40 is reduced. As a result, the tendency of the toner-containing carrier liquid to migrate to the back side of the intermediate transfer belt 40 and cause the drive performance of the intermediate transfer belt 40 to decline is reduced. The rotational surface speed of the reverse rotation cleaning roller 73 is defined to be positive when the reverse rotation cleaning roller 73 is rotating counterclockwise from the perspective of FIG. 2, and the movement speed of the intermediate transfer belt 40 is defined to be positive when the intermediate transfer belt 40 is moving in the movement direction indicated in FIG. 2.

The relationships among the length of the intermediate transfer belt 40 in a direction perpendicular to the movement direction of the intermediate transfer belt 40, the axial length of the rollers of the transfer belt cleaning section 70, and the lengths of the blades in the axial direction of the rollers will now be explained. In FIG. 5, Lt is the length of the intermediate transfer belt 40 in a direction perpendicular to the movement direction of the intermediate transfer belt 40, i.e., the length between a first edge portion 40*a* and a second edge portion 40*b* along a direction perpendicular to the movement direction, Li is a length of an image I formed on the intermediate transfer belt 40 in a direction perpendicular to the movement direction, Lb is a length of the bias cleaning roller 71 in an axial direction of the bias cleaning roller 71, i.e., an axial length between a first end portion 71*a* and a second end portion 71*b*, Ltb is a length of the transfer belt cleaning blade 75 in a direction perpendicular to the movement direction of the intermediate transfer belt 40, i.e., a distance between a first end portion 75*a* and a second end portion 75*b* in a direction perpendicular to the movement direction of the intermediate transfer belt 40.

$Lr_1$ is a length of the first reverse rotation cleaning roller $\mathbf{73}_1$, i.e., a length between a first end portion $\mathbf{73}_1a$ and a second end portion $\mathbf{73}_1b$ in an axial direction of the first reverse rotation cleaning roller $\mathbf{73}_1$, $Lr_2$ is a length of the second reverse rotation cleaning roller $\mathbf{73}_2$, i.e., a length between a first end portion $\mathbf{73}_2a$ and a second end portion $\mathbf{73}_2b$ in an axial direction of the second reverse rotation cleaning roller $\mathbf{73}_2$, $Lrb_1$ is a length of the first reverse rotation cleaning roller cleaning blade $\mathbf{74}_1$, i.e., a length between a first end portion $\mathbf{74}_1a$ and a second end portion $\mathbf{74}_1b$ in an axial direction of the first reverse rotation cleaning roller $\mathbf{73}_1$, and $Lrb_2$ is a length of the second reverse rotation cleaning roller cleaning blade $\mathbf{74}_2$, i.e., a length between a first end portion $\mathbf{74}_2a$ and a second end portion $\mathbf{74}_2b$ in an axial direction of the second reverse rotation cleaning roller $\mathbf{73}_2$.

Additionally, Lr is a length between outward sides of the reverse rotation cleaning roller 73 in an axial direction of the reverse rotation cleaning roller 73, i.e., a length between the first end portion $\mathbf{73}_1a$ of the first reverse rotation cleaning roller $\mathbf{73}_1$ and the second end portion $\mathbf{73}_2b$ of the second reverse rotation cleaning roller $\mathbf{73}_2$ in an axial direction of the reverse rotation cleaning roller 73. Meanwhile, Lri is a length between inward sides of the reverse rotation cleaning roller 73 in an axial direction of the reverse rotation cleaning roller 73, i.e., a length between the second end portion $\mathbf{73}_1b$ of the first reverse rotation cleaning roller $\mathbf{73}_1$ and the first end portion $\mathbf{73}_2a$ of the second reverse rotation cleaning roller $\mathbf{73}_2$ in an axial direction of the reverse rotation cleaning roller 73.

Additionally, Lrb is a length between outward sides of the first reverse rotation cleaning roller cleaning blade $\mathbf{74}_1$ and outward sides of the second reverse rotation cleaning roller cleaning blade $\mathbf{74}_2$ in an axial direction of the reverse rotation cleaning roller 73, i.e., a length between the first end portion $\mathbf{74}_1a$ of the first reverse rotation cleaning roller cleaning blade $\mathbf{74}_1$ and the second end portion $\mathbf{74}_2b$ of the second reverse rotation cleaning roller cleaning blade $\mathbf{74}_2$ in an axial direction of the reverse rotation cleaning roller 73. Additionally, Lrbi is a length between inward sides of the first reverse rotation cleaning roller cleaning blade $\mathbf{74}_1$ and inward sides of the second reverse rotation cleaning roller cleaning blade $\mathbf{74}_2$ in an axial direction of the reverse rotation cleaning roller 73, i.e., a length between the second end portion $\mathbf{74}_1b$ of the first reverse rotation cleaning roller cleaning blade $\mathbf{74}_1$ and the first end portion $\mathbf{74}_2a$ of the second reverse rotation cleaning roller cleaning blade $\mathbf{74}_2$ in an axial direction of the reverse rotation cleaning roller 73.

In the second embodiment, the axial length Lr between the outward sides of the reverse rotation cleaning roller 73 and the axial length Lrb between the outward sides of the reverse rotation cleaning roller cleaning blade 74 in the axial direction of the reverse rotation cleaning roller 73 are longer than the length Lt of the intermediate transfer belt 40 in a direction perpendicular to its movement direction. Meanwhile, the axial length Lri between the inward sides of the reverse rotation cleaning roller 73 and the axial length Lrbi between the inward sides of the reverse rotation cleaning roller cleaning blade 74 in the axial direction of the reverse rotation cleaning roller 73 are shorter than the length Lt of the intermediate transfer belt 40 in a direction perpendicular to its movement direction.

More specifically, the lengths satisfy the equation (2) shown below.

$$Lrbi<Lri<Li<Lb<Ltb<Lt<Lrb<Lr \quad (2)$$

For example, the length Li of an image I in a direction perpendicular to the movement direction of the intermediate transfer belt 40 could be set to 325 mm (Li=325 mm), the axial length Lb of the bias cleaning roller 71 could be set to 340 mm (Lb=340 mm), the length Ltb of the transfer belt cleaning blade 75 in a direction perpendicular to the movement direction of the intermediate transfer belt 40 could be set to 354 mm (Ltb=354 mm), the length Lt of the intermediate transfer belt 40 in a direction perpendicular to its movement direction might be set to 374 mm (Lt=374 mm), the axial length $Lr_1$ of the first reverse rotation cleaning roller $\mathbf{73}_1$ might be 100 mm ($Lr_1$=100 mm), the axial length $Lr_2$ of the second reverse rotation cleaning roller $\mathbf{73}_2$ might be 100 mm ($Lr_2$=100 mm), the length $Lrb_1$ of the first reverse rotation cleaning roller cleaning blade $\mathbf{74}_1$ in an axial direction of the reverse rotation cleaning roller 73 could be set to 100 mm ($Lrb_1$=100 mm), and the length $Lrb_2$ of the second reverse rotation cleaning roller cleaning blade $\mathbf{74}_2$ in an axial direction of the reverse rotation cleaning roller 73 could be set to 100 mm ($Lrb_2$=100 mm).

The length Lri should be shorter than the length Lt of the intermediate transfer belt 40 in a direction perpendicular to the movement direction of the intermediate transfer belt 40, and the length Lrbi should be shorter than the length Ltb of the transfer belt cleaning blade 75 in a direction perpendicular to the movement direction of the intermediate transfer belt 40.

In the second embodiment, the axial length Lr between the outward sides of the reverse rotation cleaning roller 73 and the length Lrb between the outward sides of the reverse rotation cleaning roller cleaning blade 74 in the axial direction of the reverse rotation cleaning roller 73 are longer than the length Lt of the intermediate transfer belt 40 in a direction perpendicular to its movement direction and the length Ltb of the transfer belt cleaning blade 75 in the axial direction of the reverse rotation cleaning roller 73. Thus, even if carrier liquid collects at both axially outward ends (i.e., ends located outward in axial direction of the reverse rotation cleaning roller 73) of the reverse rotation cleaning roller cleaning blade 74 when the reverse rotation cleaning roller 73 is cleaned by the reverse rotation cleaning roller cleaning blade 74, the place where the carrier liquid collects will be located farther outward in the axial direction of the reverse rotation cleaning roller 73 than the first end portion 40*a* and the second end portion 40*b* of the intermediate transfer belt 40. As a result, the tendency of the toner-containing carrier liquid to migrate to the back side of the intermediate transfer belt 40 and cause the drive performance of the intermediate transfer belt 40 to decline is reduced.

In this embodiment, the apparatus is further provided with a transfer belt cleaning blade 75 that contacts to and cleans the intermediate transfer belt 40 and is configured to be longer than the bias cleaning roller 71 in an axial direction of the rollers and shorter than the intermediate transfer belt 40 in the axial direction of the rollers. As a result, the intermediate transfer belt 40 is cleaned three times and the cleaning performance is improved.

Also, since the reverse rotation cleaning roller 73 includes a first reverse rotation cleaning roller $\mathbf{73}_1$ provided with respect to a first end portion 40*a* of the intermediate transfer belt 40 and a second reverse rotation cleaning roller $\mathbf{73}_2$ provided with respect to a second end portion 40*b* of the intermediate transfer belt 40, the reverse rotation cleaning roller 73 does not contact a middle portion of the intermediate transfer belt 40 and, thus, the load torque produced by the bias cleaning roller 71, the transfer belt cleaning blade 75, and the reverse rotation cleaning roller 73 contacting to the intermediate transfer belt 40 is reduced.

Furthermore, in the second embodiment, the length Lri between the axially inward sides of the first reverse rotation cleaning roller $\mathbf{73}_1$ and the second reverse rotation cleaning roller $\mathbf{73}_2$ and the length Lrbi between the axially inward sides (i.e., inward in the axial direction of the reverse rotational cleaning roller 73) of the first reverse rotation cleaning roller cleaning blade $\mathbf{74}_1$ and the second reverse rotation cleaning roller cleaning blade $\mathbf{74}_2$ are shorter than the length Lt of the intermediate transfer belt 40 in a direction perpendicular to the movement direction of the intermediate transfer belt 40. As a result, the first reverse rotation cleaning roller $\mathbf{73}_1$ can be arranged to contact to a first end portion 40*a* of the intermediate transfer belt 40, the second reverse rotation cleaning roller $\mathbf{73}_2$ can be arranged to contact to a second end portion 40*b* of the intermediate transfer belt 40, and the load torque produced by the bias cleaning roller 71, the transfer belt cleaning blade 75, and the reverse rotation cleaning roller 73 contacting to the intermediate transfer belt 40 can be reduced even further.

Since this embodiment employs a transfer belt cleaning blade 75 of the kind that is typically used while merely adding a reverse rotation cleaning roller 73 and a reverse rotation cleaning roller cleaning blade 74, the conventional cleaning performance is preserved while the cleaning performance with respect to liquid rings is improved. Moreover, the embodiment incurs few structural changes with respect to the conventional technology and enables manufacturing steps and development costs to be reduced.

Figure 6:
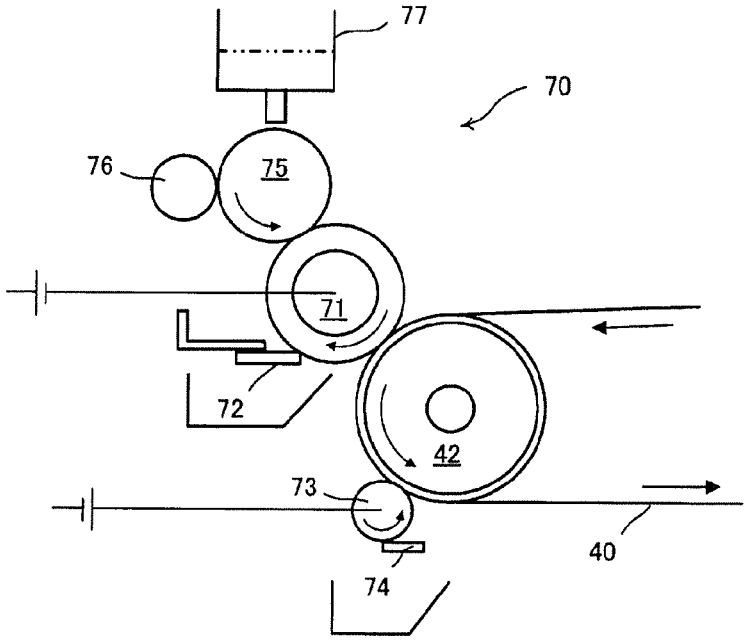
FIG. 6 shows a transfer belt cleaning section of a third embodiment.

FIG. 6 shows a third embodiment. In the third embodiment, a bias having the opposite polarity as the bias applied to the bias cleaning roller 71 is applied to the reverse rotation cleaning roller 73. Otherwise, the third embodiment has the same constituent features as the first embodiment. It is also acceptable to divide the reverse rotation cleaning roller 73 into a first reverse rotation cleaning roller $\mathbf{73}_1$ and a second reverse rotation cleaning roller $\mathbf{73}_2$ as in the second embodiment and apply a bias having the opposite polarity as the bias applied to the bias cleaning roller 71 is applied to the first and second reverse rotation cleaning rollers $\mathbf{73}_1$ and $\mathbf{73}_2$.

By applying biases having opposite polarities to the reverse rotation cleaning roller 73 and the bias cleaning roller 71, the residual toner that has been injected with an electric charge but not cleaned by the bias cleaning roller 71 can be attracted by an electric charge of the opposite polarity and removed.

The control of the transfer belt cleaning section 70 will now be explained.

Figure 7:
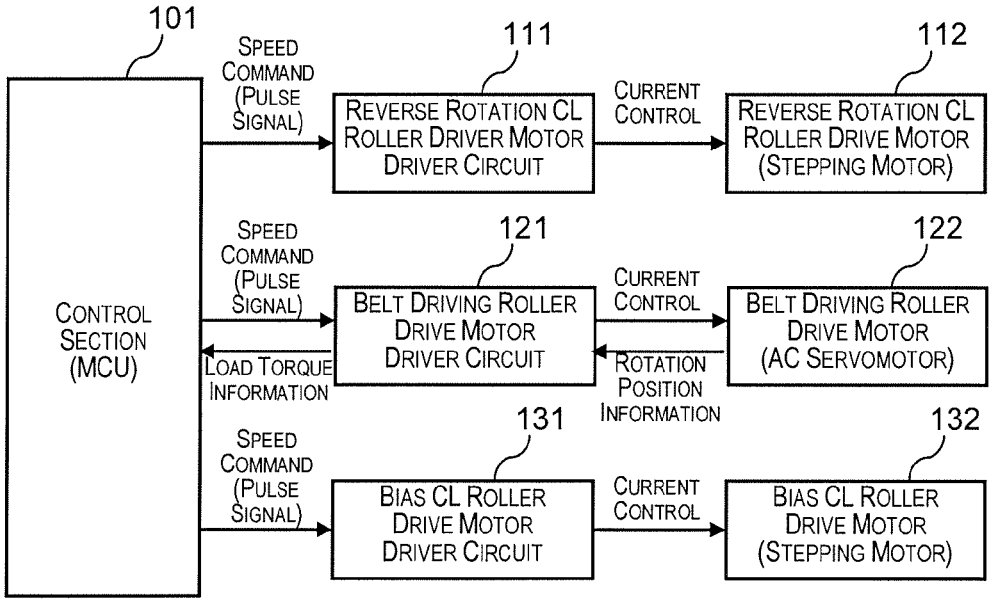
FIG. 7 is a control block diagram for the transfer belt cleaning section.

FIG. 7 is a control block diagram for the transfer belt cleaning section. In FIG. 7, the reference lettering "CL" indicates cleaning.

As shown in FIG. 7, a control section 101 includes an MCU (micro control unit) and receives rotational position information from a belt driving roller drive motor 122 including an AC servomotor and load torque information from a belt driving roller drive motor driver circuit 121. Thus, the belt driving roller drive motor driver circuit has a torque detecting section contrived to detect a load torque based on rotational position information.

The AC servomotor has a function contrived to hold the AC servomotor at a fixed rotational speed using servo control even if a load torque born by a motor shaft of the AC servomotor varies. The AC servomotor is used in a drive train in which speed irregularities can lead to a defective image. For example, when a toner image formed on the intermediate transfer belt 40 is being transferred to a sheet of paper, if the sheet of paper suddenly exerts a load against the intermediate transfer belt 40, then the belt driving roller drive motor driver circuit 121 instantly detects an irregularity in the rotation of the belt driving roller drive motor 122 based on the rotational position information and can execute a feedback control by varying a current value such that a constant rotational speed is maintained. It is also acceptable for the feedback control to be conducted through communications between the belt driving roller drive motor 122 and the belt driving roller drive motor driver circuit 121 without involving the control section 101.

After it receives the load torque information, the control section 101 sends a speed command including a pulse signal to a reverse rotation cleaning roller drive motor driver circuit 111. The reverse rotation cleaning roller drive motor driver circuit 111 controls a current flowing in a coil of a reverse rotation cleaning roller drive motor 112 including a stepping motor by turning the current on and off and varying a current value of the current, thereby controlling a rotational speed and an output torque of the reverse rotation cleaning roller drive motor 112.

Similarly, the control section 101 sends a speed command including a pulse signal to a bias cleaning roller drive motor driver circuit 131. The bias cleaning roller drive motor driver circuit 131 controls a current flowing in a coil of a bias cleaning roller drive motor 132 including a stepping motor by turning the current on and off and varying a current value of the current, thereby controlling a rotational speed and an output torque of the bias cleaning roller drive motor 132.

The control section 101 also sends a speed command including a pulse signal to the belt driving roller drive motor driver circuit 121. The belt driving roller driving motor driver circuit 121 controls a current flowing in a coil of the belt driving roller driving motor 122, which includes an AC servomotor, by turning the current on and off and varying a current value of the current, thereby controlling a rotational speed and an output torque of the belt driving roller driving motor 122.

The pulse signals constituting the speed commands sent to the motors are contrived to set the motor speeds based on a frequency value.

The control of the transfer belt cleaning section 70 will now be explained.

A friction force occurring between the reverse rotation cleaning roller 73 and the intermediate transfer belt 40 fluctuates depending on an amount of toner remaining on the intermediate transfer belt 40 and a degree of surface degradation of the intermediate transfer belt 40. When the load carried by the belt driving roller drive motor 122 changes due to a friction force fluctuation, there is a possibility that the belt driving roller drive motor 122 will not be able to maintain a constant rotational speed and the speed of the intermediate transfer belt 40 will become uneven, causing an image defect called "banding" to occur.

Therefore, in this embodiment, the load torque produced by the transfer belt cleaning blade 75 and the reverse rotation cleaning roller 73 contacting to the intermediate transfer belt 40 is reduced by controlling a rotational surface speed of the bias cleaning roller 71. The rotational surface speed of the bias cleaning roller 71 is defined to be positive when the bias cleaning roller 71 is rotating clockwise from the perspective shown in FIG. 2.

Figure 8:
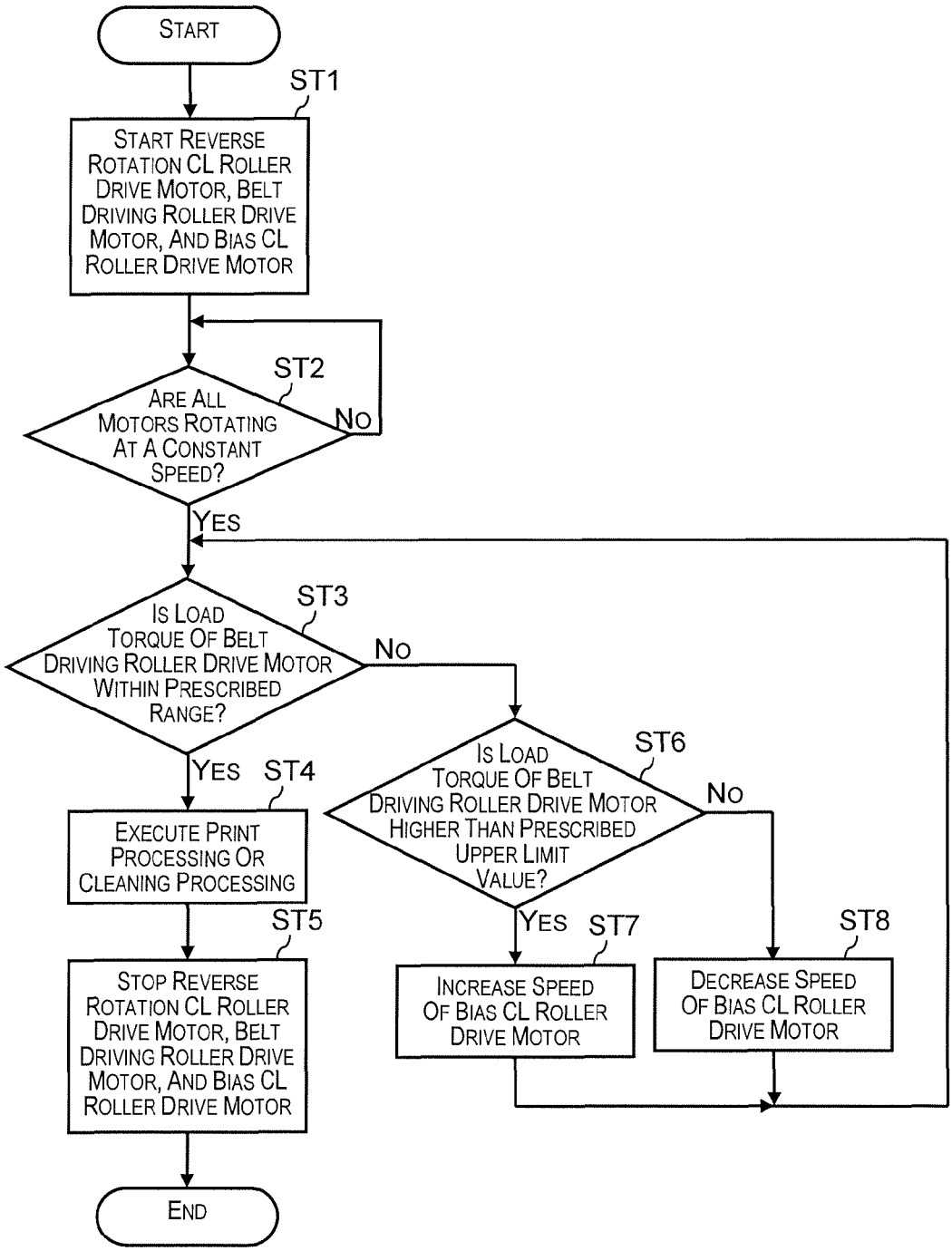
FIG. 8 is a flowchart showing control steps for cleaning the transfer belt.

FIG. 8 is a flowchart of control steps for the transfer belt cleaning section. The flowchart is executed in a program of the MCU of the control section 101 and serves to revise the rotational surface speed of the bias cleaning roller 71. The flowchart is executed during a cleaning operation executed during printing or when a power source is turned on. In FIG. 8, the reference lettering "CL" indicates cleaning.

As shown in FIG. 8, in step 1 the control section 101 starts the drive motors 112, 122, and 132 of the reverse rotation cleaning roller 73, the belt driving roller 41, and the bias cleaning roller 71 (ST1).

It is acceptable to control the rotation of the reverse rotation cleaning roller 73 such that the circumferential surface of the reverse rotation cleaning roller 73 moves in the same direction as the intermediate transfer belt 40 at the place where reverse rotational cleaning roller 73 contacts to the intermediate transfer belt 40 when the motors are started and such that, thereafter, the rotational speed of the reverse rotation cleaning roller 73 is gradually slowed and set such that the circumferential surface moves in the opposite direction as the intermediate transfer belt 40 at the place where reverse rotational cleaning roller 73 contacts to the intermediate transfer belt 40.

In this way, the initial shock occurring at the place where the intermediate transfer belt 40 and the reverse rotation cleaning roller 73 contact each other when the motors are started can be alleviated.

In step 2, the control section 101 determines if all of the drive motors 112, 122, and 132, i.e., the respective drive motors of the reverse rotation cleaning roller 73, the belt driving roller 41, and the bias cleaning roller 71, are rotating at a constant speed (ST2). If any of the drive motors is not rotating at a constant speed, then the control section 101 returns to step 2.

If it determines in step 2 that all of the drive motors 112, 122, and 132 are rotating at a constant speed, then the control section 101 proceeds to step 3 and determines if the load torque of the belt driving roller drive motor 122 is within a prescribed range determined in advance (ST3).

If it determines in step 3 that the load torque of the belt driving roller drive motor 122 is within the prescribed range determined in advance, then the control section 101 proceeds to step 4 where it executes printing processing or cleaning processing (ST4) and step 5 where it stops all of the drive motors 112, 122, and 132, i.e., the respective drive motors of the reverse rotation cleaning roller 73, the belt driving roller 41 (ST5).

If it determines in step 3 that the load torque of the belt driving roller drive motor 122 is not within the prescribed range determined in advance, then the control section 101 proceeds to step 6 where it determines if the load torque of the belt driving roller drive motor 122 is higher than an upper limit value of the prescribed range (ST6).

If it determines in step 6 that the load torque of the belt driving roller drive motor 122 is higher than the upper limit value of the prescribed range, then the control section 101 proceeds to step 7 where it executes a control to increase the rotational speed of the bias cleaning roller drive motor 132 such that the rotational surface speed of the bias cleaning roller 71 is increased (ST7).

If it determines in step 6 that the load torque of the belt driving roller drive motor 122 is not higher than the upper limit value of the prescribed range, i.e., that the load torque of the belt driving roller drive motor 122 is lower than a lower limit value of the prescribed range, then the control section 101 proceeds to step 8 where it executes a control to decrease the rotational speed of the bias cleaning roller drive motor 132 such that the rotational surface speed of the bias cleaning roller 71 is decreased (ST8).

After steps 7 and 8, the control section 101 returns to step 3.

In step 6, it is also acceptable to determine if the load torque of the belt driving roller drive motor 122 is lower than the lower limit value of the prescribed range. In such a case, if it determines that the load torque of the belt driving roller drive motor 122 is lower than the lower limit value of the prescribed range, then the control section 101 executes a control to decrease the rotational speed of the bias cleaning roller drive motor 132 such that the rotational surface speed of the bias cleaning roller 71 is decreased. Conversely, if it determines that the load torque of the belt driving roller drive motor 122 is not lower than the lower limit value of the prescribed range, i.e., that the load torque of the belt driving roller drive motor 122 is higher than the upper limit value of the prescribed range, then the control section 101 executes a control to increase the rotational speed of the bias cleaning roller drive motor 132 such that the rotational surface speed of the bias cleaning roller 71 is increased.

Thus, if the control section 101 determines that the load torque of the belt driving roller drive motor 122 is higher than the upper limit value of the prescribed range, then the control section 101 increases the rotational surface speed of the bias cleaning roller 71 by increasing the rotational speed of the bias cleaning roller drive motor 132, thereby enabling the load torque produced by the transfer belt cleaning blade 75 and the reverse rotation cleaning roller 73 contacting to the intermediate transfer belt 40 to be reduced and an appropriate rotational surface speed relationship to be obtained.

Meanwhile, if the control section 101 determines that the load torque of the belt driving roller drive motor 122 is lower than the lower limit value of the prescribed range, then the control section 101 decreases the rotational surface speed of the bias cleaning roller 71 by decreasing the rotational speed of the bias cleaning roller drive motor 132, thereby enabling the load torque produced by the transfer belt cleaning blade 75 and the reverse rotation cleaning roller 73 contacts to the intermediate transfer belt 40 to be strengthened and an appropriate rotational surface speed relationship to be obtained.

A cleaning apparatus according to this embodiment has a bias cleaning roller 71 that is arranged such that a circumferential surface thereof contacts to the moving intermediate transfer belt 40, contrived to rotate such that its circumferential surface moves in the same direction as the intermediate transfer belt 40, and contrived to apply a bias to the intermediate transfer belt 40 and a reverse rotation cleaning roller 73 that is arranged such that a circumferential surface thereof contacts to the intermediate transfer belt 40 at a position downstream of where the bias cleaning roller 71 contacts to and cleans the intermediate transfer belt 40 and contrived to rotate such that its circumferential surface moves in an opposite direction as the intermediate transfer belt 40 moves. Thus, the intermediate transfer belt 40 is cleaned twice and, furthermore, the reverse rotation cleaning roller 73 applies a large resistance force against residual toner and carrier liquid. As a result, the cleaning performance can be improved and the occurrence of a liquid ring can be reduced.

An image forming apparatus according to an aspect of the invention has the following: a photoreceptor 10Y, 10M, 10C, 10K contrived to carry a latent image; a charging device 11Y, 11M, 11C, 11K contrived to charge the photoreceptor 10Y, 10M, 10C, 10K; an exposure unit 12Y, 12M, 12C, 12K contrived to form a latent image by exposing the photoreceptor 10Y, 10M, 10C, 10K to light after the photoreceptor 10Y, 10M, 10C, 10K has been charged by the charging device 11Y, 11M, 11C, 11K; a developing device 30Y, 30M, 30C, 30K contrived to develop the latent image formed on the photoreceptor 10Y, 10M, 10C, 10K using a liquid developer containing a toner and a carrier liquid; an intermediate transfer belt 40 contrived to have an image developed on the photoreceptor 10Y, 10M, 10C, 10K is transferred thereto and to move while carrying the transferred image; a secondary transfer section 60 contrived to transfer an image carried on the intermediate transfer belt 40 to a transfer medium; and a transfer belt cleaning section 70 having a bias cleaning roller 71 and a reverse rotation cleaning roller 73, the bias cleaning roller 71 being contrived to contacts to a circumferential surface against the intermediate transfer belt 40 after the intermediate transfer belt 40 has transferred an image to the transfer medium at the intermediate transfer section 60 and to apply a bias to the intermediate transfer belt 40 while the circumferential surface of the bias cleaning roller 71 moves in the same direction as the intermediate transfer belt 40 moves and the reverse rotation cleaning roller 73 being contrived to contact to the intermediate transfer belt 40 at a position downstream of where the bias cleaning roller 71 contacts to and cleans the intermediate transfer belt 40 and to rotate such that its circumferential surface moves in a direction opposite the direction in which the intermediate transfer belt 40 moves. Thus, the intermediate transfer belt 40 is cleaned twice and, furthermore, the reverse rotation cleaning roller 73 applies a large resistance force against residual toner and carrier liquid. As a result, the cleaning performance can be improved, the occurrence of a liquid ring can be reduced, and the image quality can be improved.

Since the rotational surface speed of the reverse rotation cleaning roller 73 is larger than the movement speed of the intermediate transfer belt 40, an amount of residual toner and carrier liquid scraped off per unit time by the reverse rotation cleaning roller 73 does not depend on the type of toner, the amount of time elapsed, or other factors causing the viscosity to vary and is larger than an amount of residual toner and carrier liquid that flows to the reverse rotation cleaning roller 73 per unit time. Thus, the amount of residual toner and carrier liquid stagnating at a portion where the reverse rotation cleaning roller and the intermediate transfer belt 40 contact each other is reduced. As a result, a degree to which a drive performance of the intermediate transfer belt 40 declines due to residual toner and carrier liquid is reduced.

The apparatus also has a reverse rotation cleaning roller cleaning blade 74 contrived to contact to and clean the reverse rotation cleaning roller 73. An axial length of the reverse rotation cleaning roller 73 is longer than a length of the intermediate transfer belt 40 in a direction perpendicular to the movement direction of the intermediate transfer belt 40, and a contact width between the reverse rotation cleaning roller cleaning blade 74 and the reverse rotation cleaning roller 73 along an axial direction of the reverse rotation cleaning roller 73 is longer than a contact width between the reverse rotation cleaning roller 73 and the intermediate transfer belt 40. As a result, when the reverse rotation cleaning roller 73 is cleaned with the reverse rotation cleaning roller cleaning blade 74, even if carrier liquid collects at both ends of the reverse rotation cleaning roller cleaning blade 74, the place where the carrier liquid collects does not migrate outward beyond the intermediate transfer belt 40 in an axial direction and the occurrence of carrier liquid adhering to the intermediate transfer belt 40 is reduced.

The apparatus has an intermediate transfer belt cleaning blade 75 contrived to contact to the intermediate transfer belt 40 after the intermediate transfer belt 40 has been cleaned by the bias cleaning roller 73. Also, a contact width between the intermediate transfer belt cleaning blade 75 and the intermediate transfer belt 40 along a direction perpendicular to a movement direction of the intermediate transfer belt 40 is longer than a contact width between the bias cleaning roller 71 and the intermediate transfer belt 40, and a width of the intermediate transfer belt cleaning blade 75 in a direction perpendicular to the movement direction of the intermediate transfer belt 40 is shorter than a width of the intermediate transfer belt 40. Thus, the intermediate transfer belt 40 is cleaned three times and the cleaning performance is improved. Since the cleaning performance obtained with the intermediate transfer belt cleaning blade 75 is high, the cleaning performance of the reverse rotation cleaning roller 73 does not need to be evaluated and the cost can be held low.

The apparatus has a load torque detecting section contrived to detect a load torque occurring when the intermediate transfer belt 40 is moved and a control section 101 contrived to control a rotational surface speed of a circumferential surface of the bias cleaning roller 71 based on a value detected by the load torque detecting section. As a result, the load torque acting on the intermediate transfer belt 40 can be adjusted and an appropriate rotational surface speed relationship can be obtained.

The control section 101 is contrived to rotate the bias cleaning roller 71 at a first rotational surface speed when a value detected by the load torque detecting section is a first load torque and to rotate the bias cleaning roller 71 at a second rotational surface speed that is faster than the first rotational surface speed when a value detected by the load torque detecting section is a second load torque that is higher than higher than the first load torque. As a result, the load torque acting on the intermediate transfer belt 40 can be reduced.

The reverse rotation cleaning roller 73 is contrived to apply a bias having a polarity opposite the polarity of a bias applied to the intermediate transfer belt 40 by the bias cleaning roller 71. As a result, toner that was not cleaned by the bias cleaning roller 71 and remained on the intermediate transfer belt 40 injected with electric charge can be removed by being attracted with the opposite electric polarity.

What is claimed is:

1. An image forming apparatus, comprising:

a latent image carrier on which a latent image is formed;

a charging section that charges the latent image carrier;

an exposure section that forms the latent image by exposing light onto the latent image carrier after the latent image carrier has been charged by the charging section;

a developing section that develops the latent image formed on the latent image carrier using a liquid developer containing a toner and carrier liquid;

an image carrier on which an image is transferred from the latent image carrier and that moves while carrying the transferred image;

a transfer section that transfers the image carried on the image carrier to a transfer medium; and a cleaning section having a first cleaning roller and a second cleaning roller, wherein the first cleaning roller that contacts to the image carrier after the image on the image carrier is transferred to the transfer medium at the transfer section and that applies a bias to the image carrier while rotating such that a circumferential surface of the first cleaning roller moves in a same direction as the image carrier moves and, the second cleaning roller that contacts to the image carrier after the image carrier has been cleaned by the first cleaning roller and rotates such that a circumferential surface of the second cleaning roller moves in a direction opposite the direction in which the image carrier moves.

2. The image forming apparatus according to claim 1, wherein a rotational surface speed of the circumferential surface of the second cleaning roller is larger than a movement speed of the image carrier.

3. The image forming apparatus according to claim 1, further comprising a cleaning blade that contacts to the second cleaning roller and cleans the second cleaning roller, wherein a length of the second cleaning roller in an axial direction is longer than a length of the image carrier in a direction perpendicular to a movement direction; and a contact width between the cleaning blade and the second cleaning roller along the axial direction is longer than a contact width between the second cleaning roller and the image carrier.

4. The image forming apparatus according to claim 1, further comprising an image carrier cleaning blade that contacts to the image carrier after the image carrier has been cleaned by the first cleaning roller, wherein a contact width between the image carrier cleaning blade and the image carrier along a direction perpendicular to a movement direction of the image carrier is longer than a contact width between the first cleaning roller and the image carrier, and a width of the image carrier cleaning blade in the direction perpendicular to the movement direction of the image carrier is shorter than a width of the image carrier.

5. The image forming apparatus according to claim 1, further comprising:

a load torque detecting section that detects a load torque occurring when the image carrier is moved; and a control section that controls a rotational surface speed of the circumferential surface of the first cleaning roller based on a value detected by the load torque detecting section.

6. The image forming apparatus according to claim 5, wherein the control section controls to rotate the first cleaning roller at a first rotational surface speed when the value detected by the load torque detecting section is a first load torque, and to rotate the first cleaning roller at a second rotational surface speed that is faster than the first rotational surface speed when the value detected by the load torque detecting section is a second load torque that is higher than the first load torque.

7. The image forming apparatus according to claim 1, wherein the second cleaning roller applies a bias having a polarity opposite a polarity of the bias applied to the image carrier by the first cleaning roller.

* * * * *